US007663650B2

(12) United States Patent
Suzuki et al.

(10) Patent No.: US 7,663,650 B2
(45) Date of Patent: Feb. 16, 2010

(54) DISPLAY DEVICE

(75) Inventors: Masahiro Suzuki, Tokyo (JP); Dai Shizume, Chuo (JP); Yasunori Higuchi, Chuo (JP); Kenichiro Hosoi, Tokyo (JP)

(73) Assignee: Panasonic Corporation, Osaka (JP)

( * ) Notice: Subject to any disclaimer, the term of this patent is extended or adjusted under 35 U.S.C. 154(b) by 659 days.

(21) Appl. No.: 11/447,848

(22) Filed: Jun. 7, 2006

(65) Prior Publication Data

US 2006/0273987 A1 Dec. 7, 2006

(30) Foreign Application Priority Data

Jun. 7, 2005 (JP) ..... 2005-166511

(51) Int. Cl.
*G09G 5/10* (2006.01)
*G09G 3/28* (2006.01)

(52) U.S. Cl. ..... 345/690; 345/60; 345/63; 345/77; 345/204; 345/697

(58) Field of Classification Search ..... 345/60, 345/61, 62, 63, 64, 65, 66, 67, 68, 69, 70, 345/71, 72, 76, 77, 81, 204, 207, 690, 697; 315/160, 167, 169.1, 169.2, 169.3, 169.4
See application file for complete search history.

(56) References Cited

U.S. PATENT DOCUMENTS 6,747,616 B2 * 6/2004 Honda et al. ..... 345/63
6,762,567 B2 * 7/2004 Ide ..... 315/169.4
6,812,932 B2 * 11/2004 Kasahara et al. ..... 345/613
2002/0005842 A1 1/2002 Honda et al.
2003/0151565 A1 8/2003 Kim et al.
2004/0135748 A1 * 7/2004 Yoon et al. ..... 345/60
2004/0150586 A1 8/2004 Urakami et al.
2004/0155891 A1 8/2004 Kang
2005/0024354 A1 * 2/2005 Hosoi et al. ..... 345/204
2005/0243028 A1 * 11/2005 Usui et al. ..... 345/63
2008/0211741 A1 * 9/2008 Itakura et al. ..... 345/63

FOREIGN PATENT DOCUMENTS

DE 102 03 157 A1 8/2003
JP 11-272228 10/1999
JP 2004-240103 A 8/2004

OTHER PUBLICATIONS

European Search Report.

* cited by examiner

*Primary Examiner*—My-Chau T Tran
(74) *Attorney, Agent, or Firm*—Sughrue Mion, PLLC

(57) ABSTRACT

A brightness level frequency indicated on a frame basis by an input video signal is accumulated in decreasing order or increasing order of the brightness level so that an accumulated brightness level frequency is calculated for every brightness level. The brightness level corresponding to the accumulated brightness level frequency smaller by a predetermined value than any one of the accumulated brightness level frequencies indicated as maximum is regarded as an effective maximum brightness level. Based on this effective maximum brightness level, the number of sub-fields is determined for assignment to each different brightness segment region. With such a configuration, the resulting display device can lead to favorable halftone representation without causing viewers to feel something is wrong no matter what type of display images.

6 Claims, 11 Drawing Sheets

FIG. 3

| TONE | CONVERSION TABLE | | | | | | | | | | | | | LIGHT EMISSION DRIVE PATTERN | | | | | | | | | | | |
|---|---|---|---|---|---|---|---|---|---|---|---|---|---|---|---|---|---|---|---|---|---|---|---|---|---|
| | MD | GD 1 | 2 | 3 | 4 | 5 | 6 | 7 | 8 | 9 | 10 | 11 | 12 | SF 1 | SF 2 | SF 3 | SF 4 | SF 5 | SF 6 | SF 7 | SF 8 | SF 9 | SF 10 | SF 11 | SF 12 |
| 1 | 0000 | 1 | * | * | * | * | * | * | * | * | * | * | * | ● | | | | | | | | | | | |
| 2 | 0001 | 0 | 1 | * | * | * | * | * | * | * | * | * | * | ○ | ● | | | | | | | | | | |
| 3 | 0010 | 0 | 0 | 1 | * | * | * | * | * | * | * | * | * | ○ | ○ | ● | | | | | | | | | |
| 4 | 0011 | 0 | 0 | 0 | 1 | * | * | * | * | * | * | * | * | ○ | ○ | ○ | ● | | | | | | | | |
| 5 | 0100 | 0 | 0 | 0 | 0 | 1 | * | * | * | * | * | * | * | ○ | ○ | ○ | ○ | ● | | | | | | | |
| 6 | 0101 | 0 | 0 | 0 | 0 | 0 | 1 | * | * | * | * | * | * | ○ | ○ | ○ | ○ | ○ | ● | | | | | | |
| 7 | 0110 | 0 | 0 | 0 | 0 | 0 | 0 | 1 | * | * | * | * | * | ○ | ○ | ○ | ○ | ○ | ○ | ● | | | | | |
| 8 | 0111 | 0 | 0 | 0 | 0 | 0 | 0 | 0 | 1 | * | * | * | * | ○ | ○ | ○ | ○ | ○ | ○ | ○ | ● | | | | |
| 9 | 1000 | 0 | 0 | 0 | 0 | 0 | 0 | 0 | 0 | 1 | * | * | * | ○ | ○ | ○ | ○ | ○ | ○ | ○ | ○ | ● | | | |
| 10 | 1001 | 0 | 0 | 0 | 0 | 0 | 0 | 0 | 0 | 0 | 1 | * | * | ○ | ○ | ○ | ○ | ○ | ○ | ○ | ○ | ○ | ● | | |
| 11 | 1010 | 0 | 0 | 0 | 0 | 0 | 0 | 0 | 0 | 0 | 0 | 1 | * | ○ | ○ | ○ | ○ | ○ | ○ | ○ | ○ | ○ | ○ | ● | |
| 12 | 1011 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ● |
| 13 | 1100 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ |

*: 0 OR 1

● : SELECTIVE DELETION DISCHARGE

○ : SUSTAIN DISCHARGE LIGHT EMISSION

DISPLAY DEVICE

BACKGROUND OF THE INVENTION

1. Field of the Invention

The present invention relates to a display device that applies a sub-field method to represent a halftone.

2. Description of the Related Art

Current types of display devices are equipped with a plasma display panel (hereinafter, referred to as PDP), or an electroluminescent display panel (hereinafter, ELPD) as a thin flat display panel. In these PDP and ELDP, light-emitting devices, as pixels, are to be in only two states of "light emission" and "no light emission". In consideration thereof, to derive halftones corresponding to any incoming video signal, a sub-field method is applied to halftone-drives for display panels such as PDPs and ELDPs.

With the sub-field method, an input video signal is converted into N-bit pixel data for every pixel. Based on each of the bit digits of the N bits, a field display period is divided into N sub-fields. The sub-fields are each assigned to the number of light emissions, which corresponds to the respective bit digits of the pixel data. When the logic level of one bit digit in the N bits is "1", in the sub-field corresponding to the bit digit, the light is emitted for the number of assigned times described above. On the other hand, when the logic level of the bit digit is "0", in the sub-field corresponding to the bit digit, the light is not emitted. With such a driving method, the number of light emissions is summed up for every sub-field in a field display period. Based on the summed value, the halftone corresponding to an input video signal is represented. Japanese Patent Application Kokai No. 2004-240103 has recently proposed another type of driving method. In the driving method, an input video signal is used as a basis to generate brightness frequency data on a screen basis. The brightness frequency data represents the frequency for each level of brightness. Based on the resulting brightness frequency data, the number of sub-fields is adjusted for every brightness region depending on its frequency. This driving method provides favorable tone representation suiting the characteristics of human sight by assigning the larger number of sub-fields to the brightness segment region of a frequency larger in value.

The problem with such a driving method is that, however, if any high-bright text display such as a news flash, e.g., about an earthquake, is made during image display of television broadcasting, the number of sub-fields to be assigned to the brightness segment regions is abruptly changed. The resulting display makes viewers feel that something is wrong.

SUMMARY OF THE INVENTION

The present invention is proposed to solve the above-described problems, and an object thereof is to provide a display device with favorable halftone representation without causing viewers to feel something is wrong no matter what type of display images.

A first aspect of the invention is directed to a display device in which a field display period of an input video signal is configured by a plurality of sub-fields each assigned with a light-emitting period, and pixel cells serving as pixels of a display panel are made to emit light for each of the sub-fields for halftone representation. The display device includes: a brightness level frequency generation unit for deriving, as a brightness level frequency, a frequency for every brightness level of the input video signal on a frame basis; an accumulated brightness level frequency generation unit for deriving an accumulated brightness level frequency corresponding to each of the brightness levels by adding the brightness level frequency; and a control unit for setting the number of sub-fields for assignment to each different brightness segment region based on an effective maximum brightness level, which is the brightness level corresponding to the accumulated brightness level frequency that is smaller by a predetermined value than any one of the accumulated brightness level frequencies indicated as maximum.

A second aspect of the invention is directed to a display device in which a field display period of an input video signal is configured by a plurality of sub-fields each assigned with a light-emitting period, and pixel cells serving as pixels of a display panel are made to emit light for each of the sub-fields for halftone representation. The display device includes: a brightness level frequency generation unit for deriving, as a brightness level frequency, a frequency for every brightness level of the input video signal on a frame basis; an accumulated brightness level frequency generation unit for deriving an accumulated brightness level frequency corresponding to each of the brightness levels by adding the brightness level frequency; an ambient light sensor that detects a light intensity around the display panel as an ambient light intensity; and a control unit for setting the number of sub-fields for assignment to each different brightness segment region based on the ambient light intensity and an effective maximum brightness level, which is the brightness level corresponding to the accumulated brightness level frequency that is smaller by a predetermined value than any one of the accumulated brightness level frequencies indicated as maximum.

A third aspect of the invention is directed to a display device in which a field display period of an input video signal is configured by a plurality of sub-fields each assigned with a light-emitting period, and pixel cells serving as pixels of a display panel are made to emit light for each of the sub-fields for halftone representation. The display device includes: a brightness level frequency generation unit for deriving, as a brightness level frequency, a frequency for every brightness level of the input video signal on a frame basis; an accumulated brightness level frequency generation unit for deriving an accumulated brightness level frequency corresponding to each of the brightness levels by adding the brightness level frequency; an ambient light sensor that detects a light intensity around the display panel as an ambient light intensity; and a control unit for setting the number of sub-fields for assignment to each different brightness segment region based on the ambient light intensity and the accumulated brightness level frequency.

BRIEF DESCRIPTION OF THE DRAWINGS

FIG. 3 is a diagram showing a data conversion table and a light emission drive pattern in a drive data conversion circuit 5 of FIG. 1;

DETAILED DESCRIPTION OF THE INVENTION

FIRST EMBODIMENT

Figure 1:
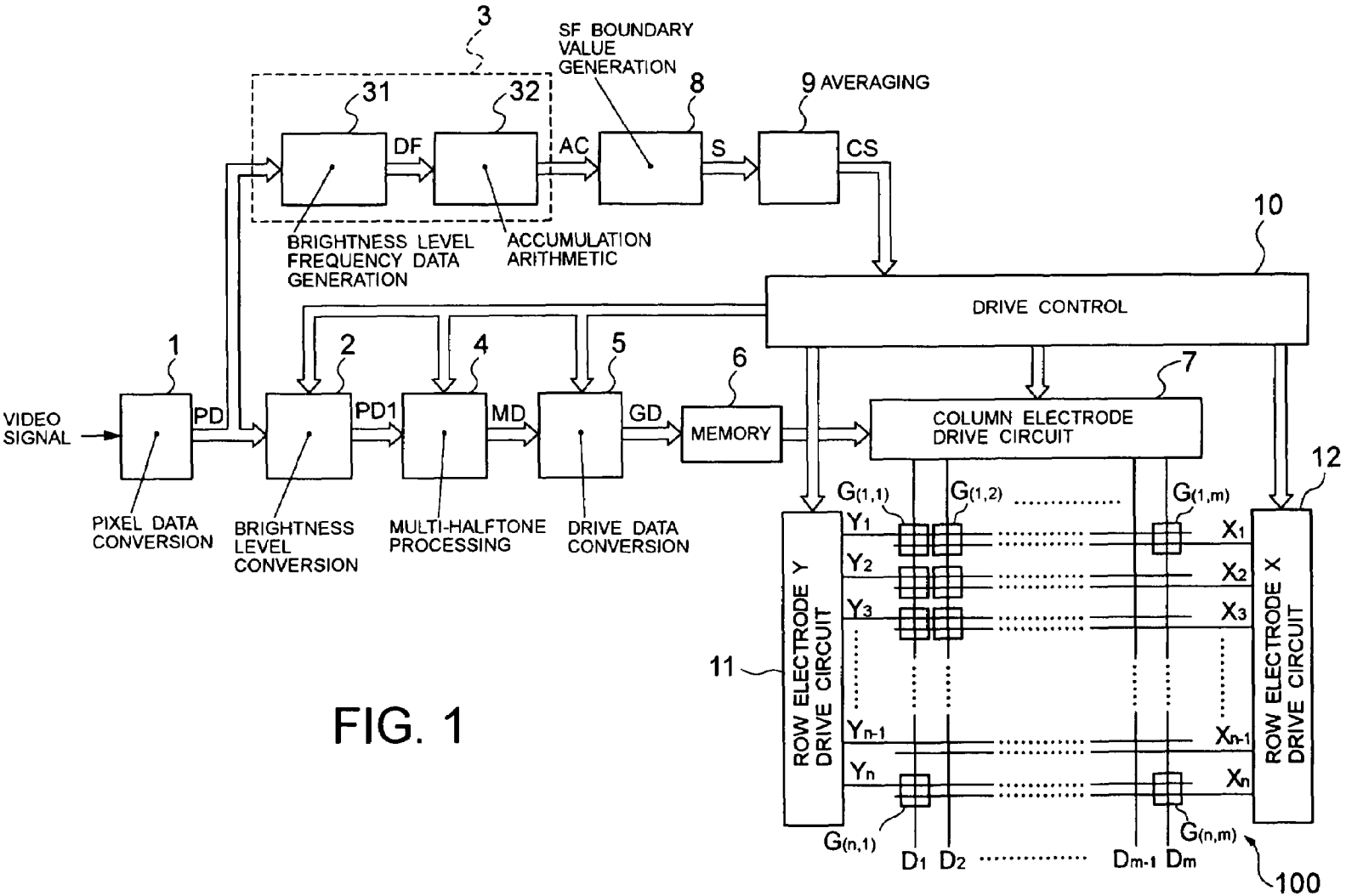
FIG. 1 is a diagram showing the schematic configuration of a plasma display device as a display device of the present invention.

FIG. 1 is a diagram showing the configuration of a plasma display device equipped with a plasma display panel as a display panel.

In FIG. 1, a plasma display panel PDP 100 is provided with a transparent front substrate (not shown) serving as a display surface, and a rear substrate (not shown) disposed at a position facing the front substrate. Between the front and rear substrates, there is a discharge space filled with a discharge gas. The front substrate is formed with row electrodes $X_1$ to $X_n$ and $Y_1$ to $Y_n$ that extend in the horizontal direction (lateral direction) of the surface plane. The rear substrate is formed with column electrodes $D_1$ to $D_m$, which are disposed to cross the row electrodes. Note here that the row electrodes $X_1$ to $X_n$ and $Y_1$ to $Y_n$ are so configured that a pair of row electrodes X and Y serves as the 1st to nth display lines of the PDP 100. At the intersection portion (discharge space included) of such a row electrode pair and a column electrode, a discharge cell (pixel cell) G is formed. That is, the PDP 100 is formed with (n×m) discharge cells $G_{(1,1)}$ to $G_{(n,m)}$ in a matrix.

A pixel data conversion circuit 1 converts an input video signal into 8-bit pixel data PD representing the brightness level for every pixel, for example. The resulting pixel data PD is forwarded to both a brightness level conversion circuit 2 and a brightness accumulated frequency arithmetic circuit 3. Here, the input video signal is a signal derived by applying gamma correction to a source video signal corresponding to a video for display.

Figure 2:
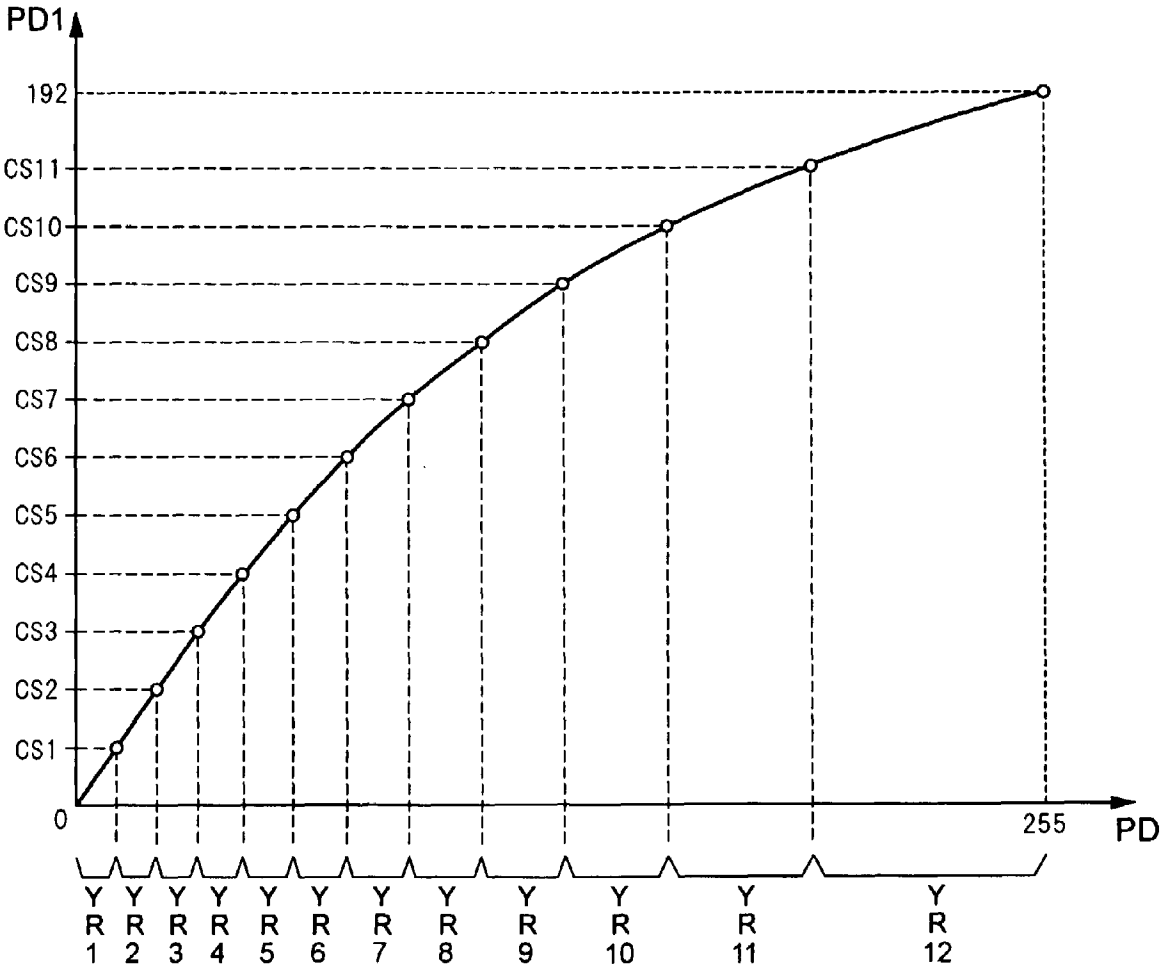
FIG. 2 is a diagram showing exemplary conversion characteristics in a brightness level conversion circuit 2 of FIG. 1.

For the 8-bit pixel data PD representing the brightness levels of "0" to "255", the brightness level conversion circuit 2 performs brightness level conversion based on conversion characteristics of FIG. 2 based on averaged SF boundary values CS1 to CS12 that will be described later. That is, in the brightness level conversion circuit 2, first of all, a brightness range of "0" to "255" represented by an input video signal is divided into 12 brightness regions YR1 to YR12 corresponding to the sub-fields SF1 to SF12, respectively. The brightness level is then extracted at the boundary between any adjacent brightness regions YR, and then the brightness level conversion is executed to the pixel data PD. Such conversion execution utilizes the conversion characteristics in which the after-conversion values (PD1) corresponding to the extracted brightness levels are to be the averaged SF boundary values CS1 to CS11.

A multi-halftone processing circuit 4 subjects the 8-bit pixel data PD1 to an error diffusion process and dithering. For example, in the error diffusion process, the high-order 6 bits of the pixel data PD1 is regarded as display data, and the remaining low-order 2 bits as error data. The error data of the pixel data PD1 corresponding to each neighboring pixels is weighed and added, and the result is reflected to the display data. With such an operation, the brightness of the low-order 2 bits of the original pixel is artificially represented by the neighboring pixels. Therefore, 6-bit display data of a fewer number of bits than 8 bits enables brightness halftone representation equivalent to the 8-bit pixel data. After such an error diffusion process, the resulting 6-bit error-diffused pixel data is subjected to dithering. With dithering, any adjacent pixels are regarded as a pixel unit, and the error-diffused pixel data corresponding to each of the pixels in a pixel unit are respectively assigned with each different dithering coefficient. The dithering coefficients are added together so that dithering-added pixel data is derived. By going through such addition of dithering coefficients, in view of a pixel unit, only the high-order 4 bits of the dithering-added pixel data can represent the brightness equivalent to 8 bits. In consideration thereof, the multi-halftone processing circuit 4 forwards, to a drive data conversion circuit 5, the high-order 4 bits of the dithering-added pixel data as multi-halftone pixel data MD.

The drive data conversion circuit 5 converts the multi-halftone pixel data MD into 12-bit pixel drive data GD for transmission to a memory 6. Such conversion is performed in accordance with a data conversion table of FIG. 3.

The memory 6 sequentially acquires the 12-bit pixel drive data GD for storage. Every time the writing of the pixel drive data $GD_{1.1}$ to $GD_{n.m}$ is completed for an image frame (n-rows×m-columns), the memory 6 separates the pixel drive data $GD_{1.1}$ to $GD_{n.m}$ on a bit digit basis. The memory 6 then reads each display line corresponding to the sub-fields SF1 to SF12, which will be described later. The memory 6 supplies, to a column electrode drive circuit 7, the (m) pixel drive data bits of any one read display line as pixel drive data bits DB1 to DB(m). For example, for the sub-field SF1, the memory 6 reads, for each display line, only the 1st bit of each of the pixel drive data $GD_{1.1}$ to $GD_{n.m}$, and supplies the result to the column electrode drive circuit 7 as the pixel drive data bits DB1 to DB(m). For the sub-field SF2, the memory 6 reads, for each display line, only the 2nd bit of each of the pixel drive data $GD_{1.1}$ to $GD_{n.m}$, and supplies the result to the column electrode drive circuit 7 as the pixel drive data bits DB1 to DB(m).

The brightness accumulated frequency arithmetic circuit 3 is configured by a brightness level frequency data generation circuit 31 and an accumulation arithmetic circuit 32.

The brightness level frequency data generation circuit 31 is provided with 256 storage regions corresponding, respectively, to values of "0" to "255" in a brightness level range, which can be represented by the pixel data PD. Each of the 256 storage regions stores the total number of times each region is provided with the pixel data PD representing its corresponding brightness level, i.e., total frequency. For example, every time the pixel data PD comes from the pixel data conversion circuit 1, the brightness level frequency data generation circuit 31 increments by "1" the frequency stored in the storage region corresponding to the brightness level represented by the pixel data PD. For every frame (or a field) of the input video signal, the brightness level frequency data generation circuit 31 supplies brightness level frequencies $DF_0$ to $DF_{255}$ to the accumulation arithmetic circuit 32. The brightness level frequencies $DF_0$ to $DF_{255}$ are those generated by the pixel data PD of a frame (or a field), and represent the frequencies for the brightness levels of "0" to "255".

The accumulation arithmetic circuit 32 derives accumulated brightness level frequencies $AC_0$ to $AC_{255}$ corresponding to, respectively, the brightness levels "0" to "255". The accumulated brightness level frequencies $AC_0$ to $AC_{255}$ are the addition results derived by sequentially adding the brightness level frequencies $DF_0$ to $DF_{255}$, starting from the one corresponding to the low brightness (or starting from the one corresponding to the high brightness). That is, the accumulation arithmetic circuit 32 calculates the accumulated brightness level frequencies $AC_0$ to $AC_{255}$ representing, respectively, the accumulated frequencies of the brightness for the brightness levels "0" to "255" by going through the following calculation:

$$AC_{0=DF0}$$

$$AC_1=DF_0+DF_1$$

$$AC_2=DF_0+DF_1+DF_2$$

$$\ldots$$

$$AC_{255}=DF_0+DF_1+DF_2+DF_3+\ldots DF_{255}$$

The accumulation arithmetic circuit 32 supplies these accumulated brightness level frequencies $AC_0$ to $AC_{255}$ to an SF (sub-field) boundary value generation circuit 8.

Figure 4:
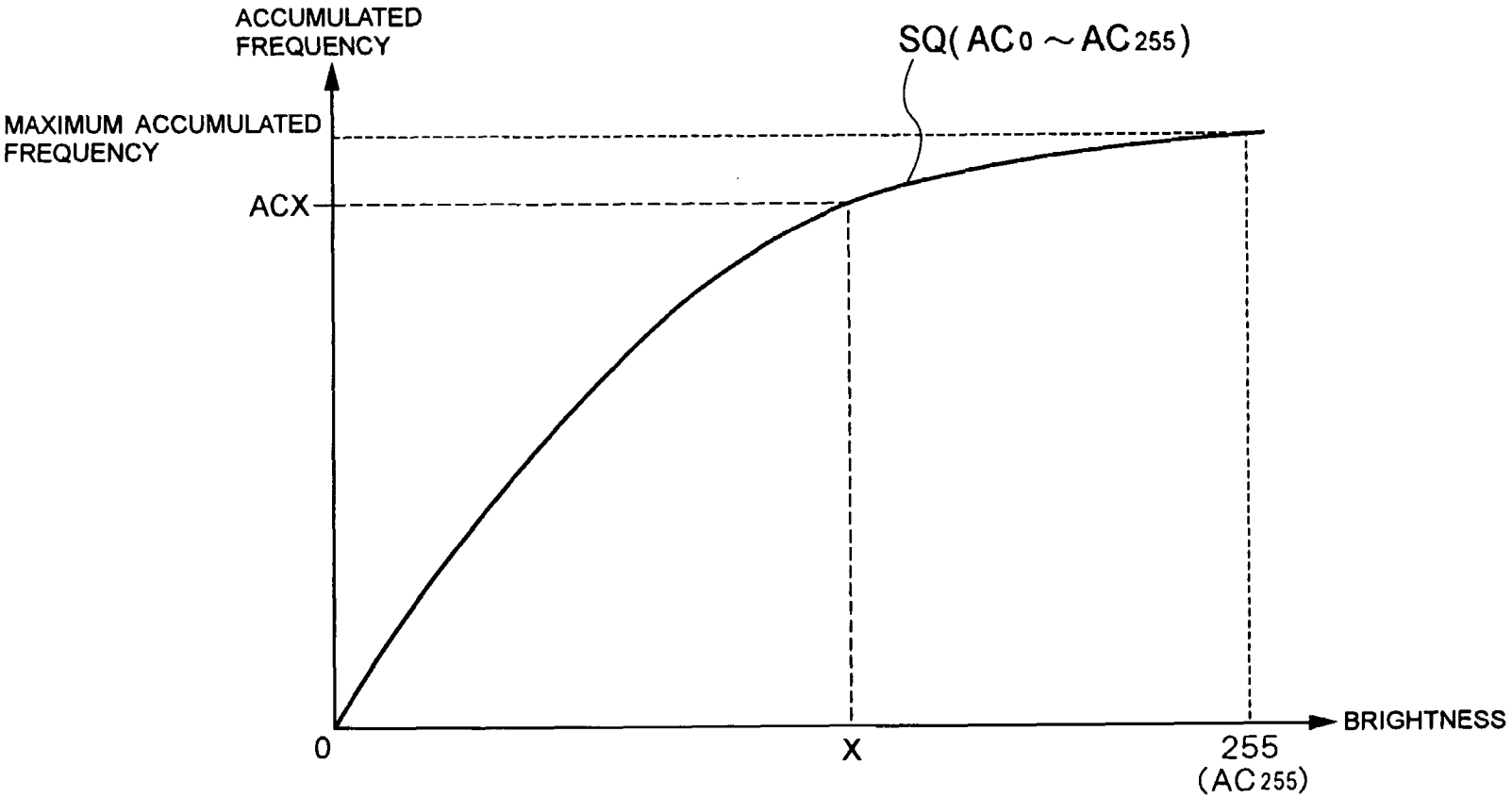
FIG. 4 is a diagram showing exemplary accumulated brightness level frequencies $AC_0$ to $AC_{255}$.

FIG. 4 is a diagram showing an accumulated brightness level frequency sequence SQ, which indicates a sequence in which the accumulated brightness level frequencies $AC_0$ to $AC_{255}$ are correlated with each corresponding brightness level.

Based on the accumulated brightness level frequencies $AC_0$ to $AC_{255}$, the SF boundary value generation circuit 8 generates SF boundary values S1 to S11 for transmission to an averaging circuit 9, which will be described later. The SF boundary values S1 to S11 indicate the boundary values of a brightness range for the sub-fields SF1 to SF12, which will be described later.

The averaging circuit 9 supplies averaged SF boundary values CS1 to CS11 to a drive control circuit 10. These averaged SF boundary values CS1 to CS11 are derived by applying an averaging process to, separately, the SF boundary values S1 to S11. The averaging circuit 9 is exemplified by a circulating low-pass filter. With this being the case, the averaging circuit 9 executes a circulating low-pass filtering process using the SF boundary value S1 generated based on a video signal of a preceding frame, and the SF boundary value S1 generated based on a video signal of the current field. The resulting output value is then supplied to the drive control circuit 10 as the averaged SF boundary value CS1. The averaging circuit 9 also executes the circulating low-pass filtering process this time using the SF boundary value S2 generated based on a video signal of a preceding frame, and the SF boundary value S2 generated based on a video signal of the current field. The resulting output value is then supplied to the drive control circuit 10 as the averaged SF boundary value CS2. The averaging circuit 9 also executes the circulating low-pass filtering process using the SF boundary value S3 generated based on a video signal of a preceding frame, and the SF boundary value S3 generated based on a video signal of the current field. The resulting output value is then supplied to the drive control circuit 10 as the averaged SF boundary value CS3. In a similar manner, the averaging circuit 9 executes a circulating low-pass filtering process to, separately, the SF boundary values S4 to S11, and the results of the averaged SF boundary values CS4 to CS11 are provided to the drive control circuit 10.

Figure 5:
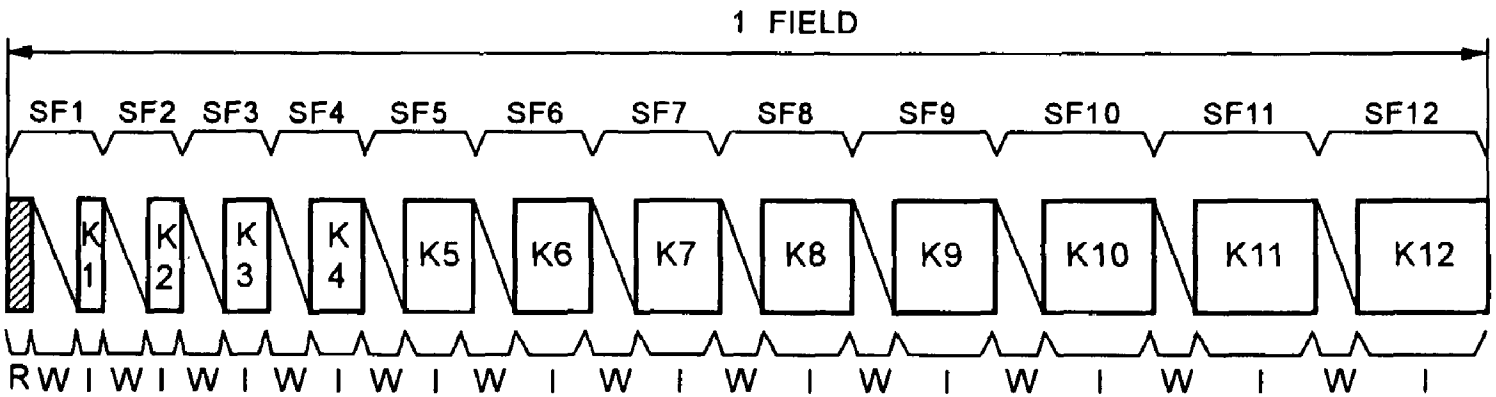
FIG. 5 is a diagram showing an exemplary light emission drive sequence when a PDP 100 of FIG. 1 is driven.

In accordance with a light emission drive sequence of FIG. 5 based on the sub-field method, the drive control circuit 10 supplies various types of timing signals to the column electrode drive circuit 7, a row electrode Y drive circuit 11, and a row electrode X drive circuit 12 for halftone-driving of the PDP 100.

In the light emission drive sequence of FIG. 5, a display period for a frame is configured by the sub-fields SF1 to SF12. In the respective sub-fields, an address process W and a sustain process I are executed in order. Note here that, only to the sub-field SF1 at the head, a reset process R is executed prior to the address process W.

First of all, in the reset process R for the head sub-field SF1, the row electrode Y drive circuit 11 and the row electrode X drive circuit 12 apply a reset pulse to each of the row electrodes X and Y. In response to such reset pulses, reset discharge is started in every discharge cell G so that the discharge cells G have a wall charge of a predetermined amount. As a result, every discharge cell G is set to an illumination mode, in which sustain discharge light emission is enabled in the sustain process I that will be described later.

Next, in the address process W of the respective sub-fields, the row electrode Y drive circuit 11 sequentially applies a scanning pulse to the row electrodes $Y_1$ to $Y_n$ of the PDP 100. During this time, the column electrode drive circuit 7 applies m pixel data pulses to the column electrodes $D_1$ to $D_m$ in synchronization with the timing of the scanning pulse. The m pixel data pulses are for a display line corresponding to the pixel drive data bits DB1 to DB(m) read from the memory 6. Here, deletion address discharge is started only to the discharge cell(s) that receive high-voltage pixel data pulses together with the scanning pulse. Such deletion address discharge eliminates the wall discharge formed in the discharge cells, and such wall-charge-eliminated discharge cells are set to a turn-off mode in which sustain discharge light emission is not started in the sustain process I, which will be described later. On the other hand, no such deletion address discharge is started for the discharge cell(s) that receive the low-voltage pixel data pulses together with the scanning pulse, and the immediately preceding state is sustained (illumination mode or turn-off mode).

Next, in the sustain process I of the respective sub-fields, the row electrode Y drive circuit 11 and the row electrode X drive circuit 12 both repeatedly generate a sustain pulse over a light emission period K that is set by the drive control circuit 10. Thus generated sustain pulses are applied to each of the row electrodes X and Y alternately. At this time, only in the discharge cell(s) G set to the illumination mode, sustain discharge light emission is started every time the sustain pulse is applied.

At this time, by the driving operation of FIG. 5, for the sub-fields SF1 to SF12, the discharge cells can be changed from the turn-off mode to the illumination mode only during the reset process R of the sub-field SF1. That is, after the deletion address discharge is started in any one of the sub-fields SF1 to SF12, and once the discharge cell(s) G are set to the turn-off mode, the discharge cell(s) G are never set again to the illumination mode in the subsequent sub-fields. Therefore, by the driving operation based on 13 different pixel driving data GD as shown in FIG. 3, the discharge cells G are set to the turn-off mode in the sub-fields subsequent to the first sub-field SF1 by a number corresponding to the brightness. At this time, until the deletion address discharge (indicated by black circles) is started, the sustain discharge light emission (indicated by white circles) continues in the sustain process I for the respective sub-fields.

By such a driving operation, the brightness corresponding to the total length of light emission started by sustain discharge light emission in a frame period can be observed. That is, according to 13 different emission patterns of FIG. 3, the middle brightness for 13 different halftones is represented corresponding to the total time length of the light emission period K, which is assigned to the sustain process I of the sub-fields indicated by white circles.

Herein, the light emission periods K1 to K12 of FIG. 5 assigned to the sustain process I of the sub-fields SF1 to SF12, respectively, are set by the averaged SF boundary values CS1 to CS11 derived by averaging, separately, the SF boundary values S1 to S11.

The operation of the SF boundary value generation circuit 8 is now described, which generates the SF boundary values S1 to S11.

The SF boundary value generation circuit 8 regards Q %, e.g., 90%, of the maximum accumulated frequency as an effective maximum accumulated brightness level frequency ACX of FIG. 4. The maximum accumulated frequency is indicated by the accumulated brightness level frequency $AC_{255}$ provided by the brightness accumulated frequency arithmetic circuit 3. Next, the SF boundary value generation circuit 8 detects the brightness level corresponding to the effective maximum accumulated brightness level frequency ACX, and regards the detection result as an effective maximum brightness level X. Here, such detection is made from the accumulated brightness level frequency sequence SQ including the accumulated brightness level frequencies $AC_0$ to $AC_{255}$ as shown in FIG. 4. Next, based on the effective maximum brightness level X, the SF boundary value generation circuit 8 generates the SF boundary values S1 to S11 indicating the boundary values of a brightness range for the sub-fields SF1 to SF12.

Figure 6:
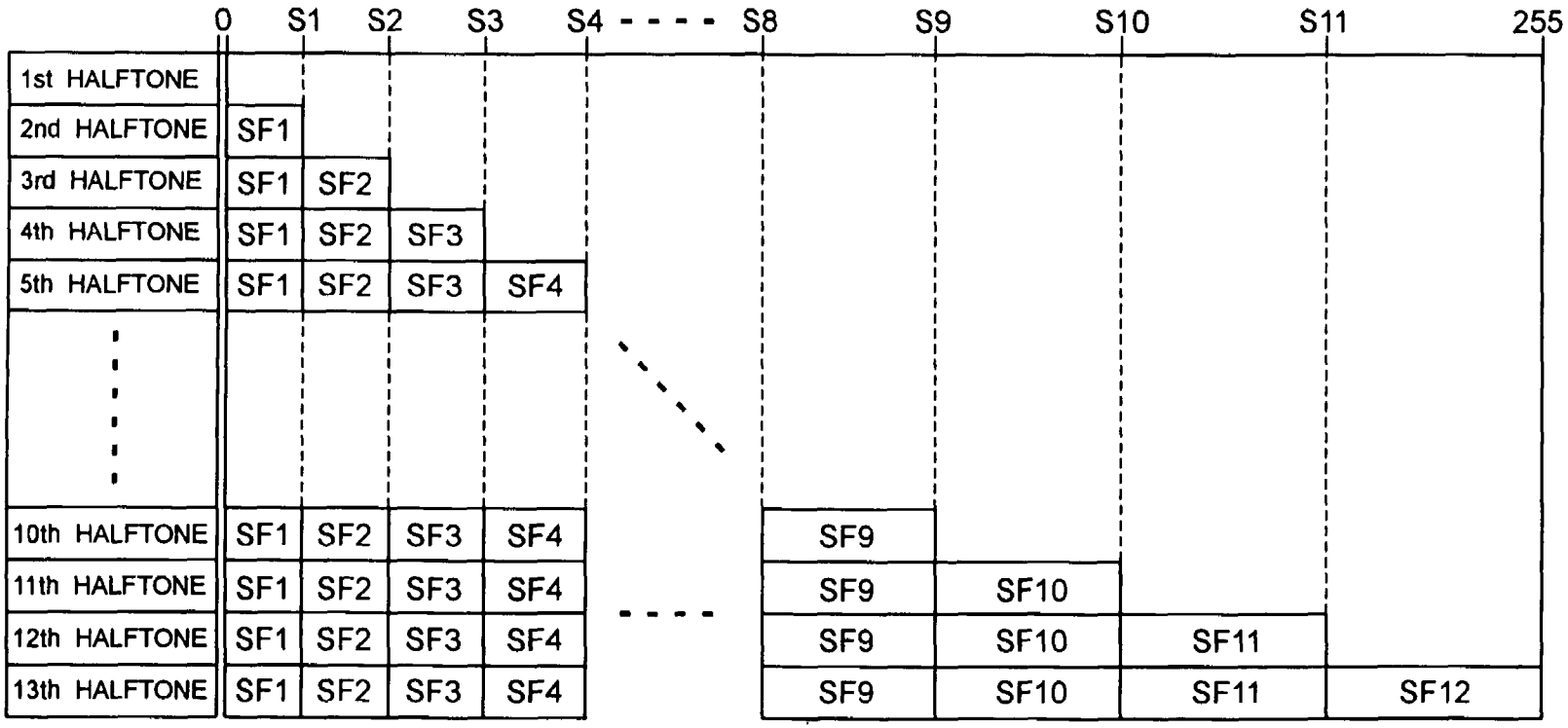
FIG. 6 is a diagram showing SF boundary values S1 to S11 in sub-fields SF1 to SF12.

That is, according to the 13 different light emission drive patterns as shown in FIG. 3, except for a case where the brightness level "0" is represented, sustain discharge light emission is started in the sub-fields, starting from the sub-field SF1, and represented thereby is the brightness level corresponding to the number of sub-fields in succession. In more detail, as shown in FIG. 6, with the first halftone driving representing the minimum brightness level "0", sustain discharge light emission is not started in any of the sub-fields SF1 to SF12. With the second halftone driving representing the brightness level higher than the first halftone driving, by only 1 level, sustain discharge light emission is started only in the sub-field SF1. With the third halftone driving representing the brightness level higher than the second halftone driving, by only 1 level, sustain discharge light emission is started successively in the sub-fields SF1 and SF2. With the fourth halftone driving representing the brightness level higher than the third halftone driving, by only 1 level, sustain discharge light emission is started successively in the sub-fields SF1 to SF3. Accordingly, the sub-field SF1 is of the minimum brightness level, and the sub-field SF12 is of the maximum brightness level.

Figure 7:
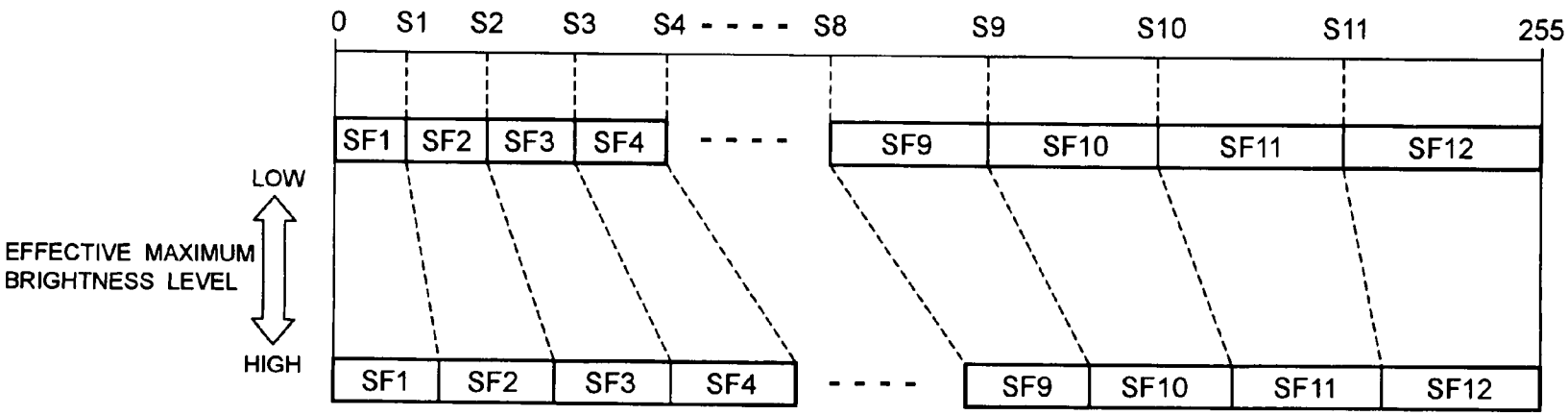
FIG. 7 is a diagram showing the correlation between an effective maximum brightness level X and the SF boundary values S1 to S11.

As shown in FIG. 6, the SF boundary value generation circuit 8 calculates the boundary values of a brightness range for any adjacent sub-fields as the SF boundary values S1 to S11. At this time, as shown in FIG. 7, the SF boundary value generation circuit 8 narrows the brightness range for the sub-fields of higher brightness, e.g., SF9 to SF12, as the effective maximum brightness level X becomes larger, and generates the SF boundary values S1 to S11 whose brightness range is widened thereby for each of the sub-fields of lower brightness (for example, SF1 to SF4). As such, based on the averaged SF boundary values CS1 to CS11 derived by averaging, separately, the SF boundary values S1 to S11, the drive control circuit 10 derives the light emission periods K1 to K12 to be assigned to the sub-fields SF1 to SF12, respectively.

With such an operation, when a one-frame video signal has a relatively high proportion of high-brightness components, the number of sub-fields is increased for assignment to the high-brightness components. When the video signal has a relatively high proportion of low-brightness components, the number of sub-fields is increased for assignment to the low-brightness components.

Figure 8A:
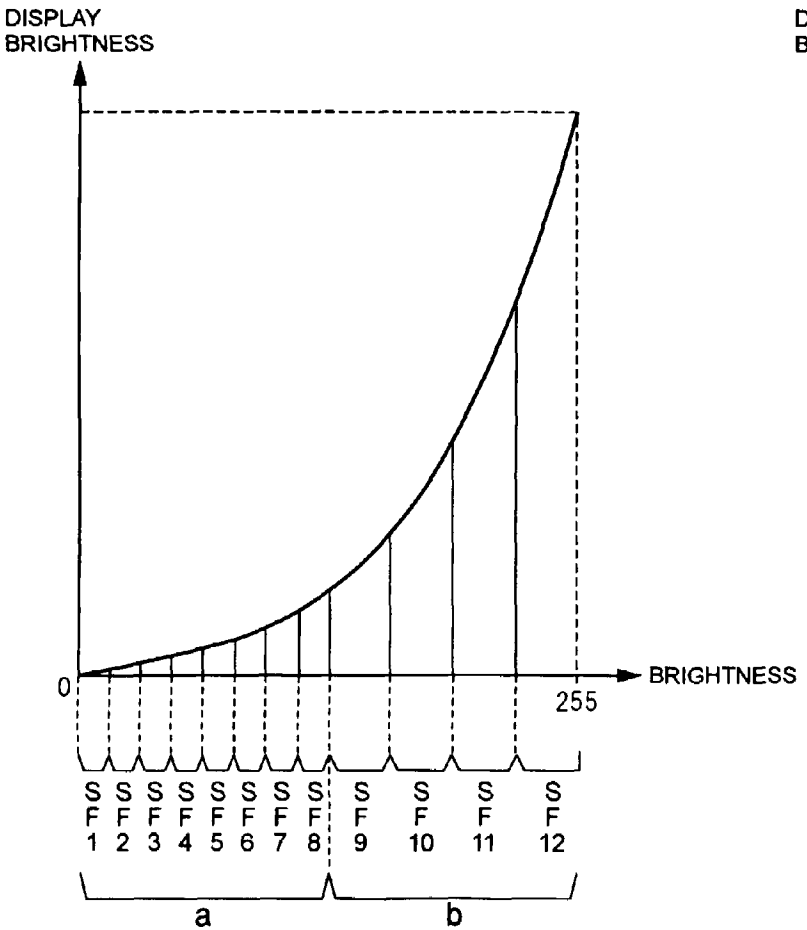
FIGS. 8A and 8B are each a diagram showing exemplary assignment of the sub-fields SF1 to SF11 to a low-brightness segment region a and a high-brightness segment region b.
Figure 8B:
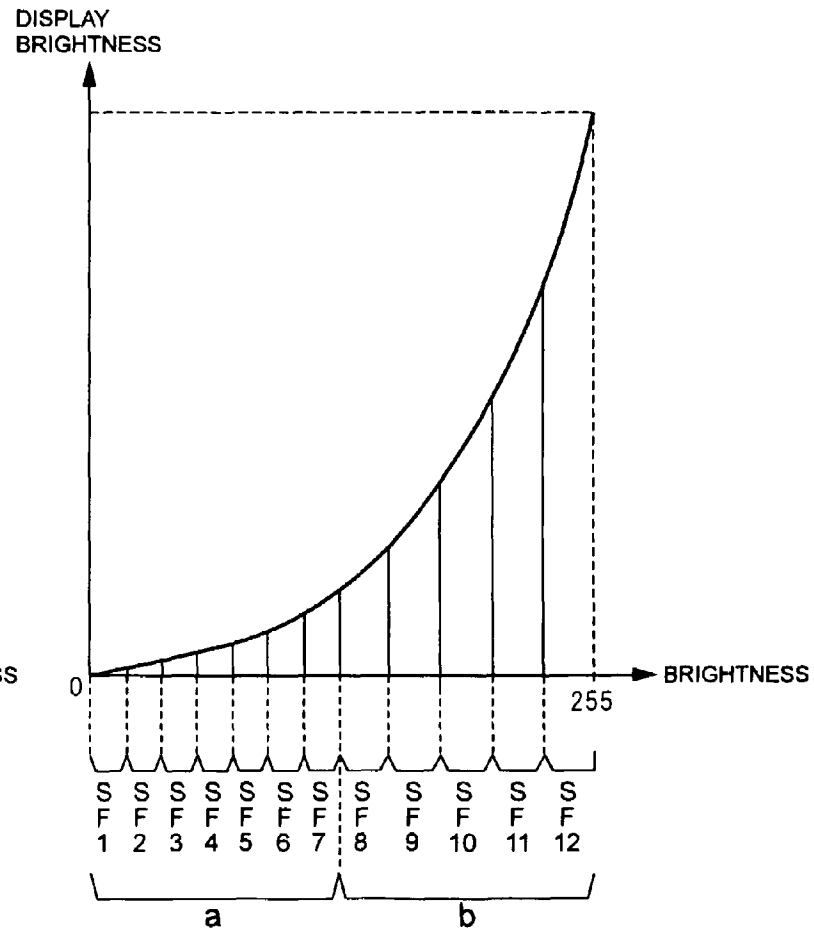

For example, when the effective maximum brightness level X is relatively low, i.e., when the proportion of the high-brightness components is low in a one-frame image, as shown in FIG. 8A, a low-brightness segment region a is assigned to 8 sub-fields of SF1 to SF8, and a high-brightness segment region b is assigned to 4 sub-fields of SF9 to SF12. On the other hand, when the effective maximum brightness level X is relatively high, i.e., when a proportion of the high-brightness components is high in a one-frame image, as shown in FIG. 8B, the low-brightness segment region a is assigned to 7 sub-fields of SF1 to SF7, and the high-brightness segment region b is assigned to 5 sub-fields of SF8 to SF12.

Therefore, with such an operation, the favorable halftone representation suitable for the brightness distribution of a display image is achieved.

Described next is the operation when an incoming video signal includes text information such as subtitles or newsbar in a main image.

Figure 9A:
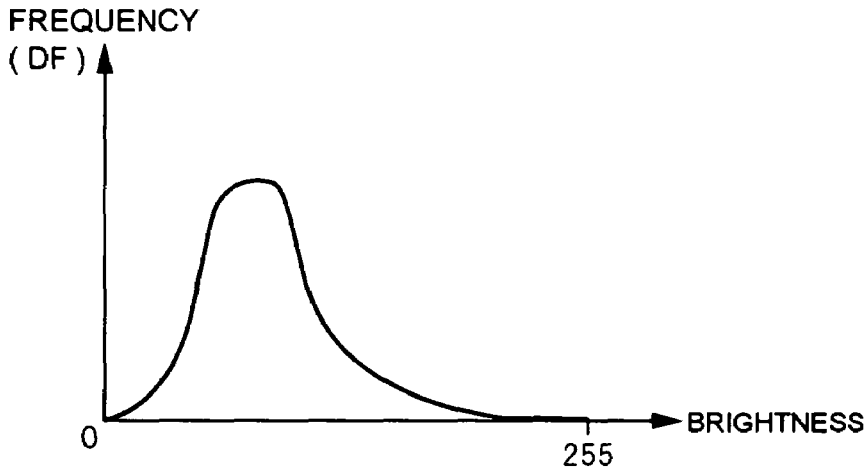
FIGS. 9A and 9B are diagrams showing, respectively, an exemplary brightness level frequency DF and an exemplary accumulated brightness level frequency AC to be generated based on a video signal of a video including no text information, e.g., subtitles or newsbar.
Figure 9B:
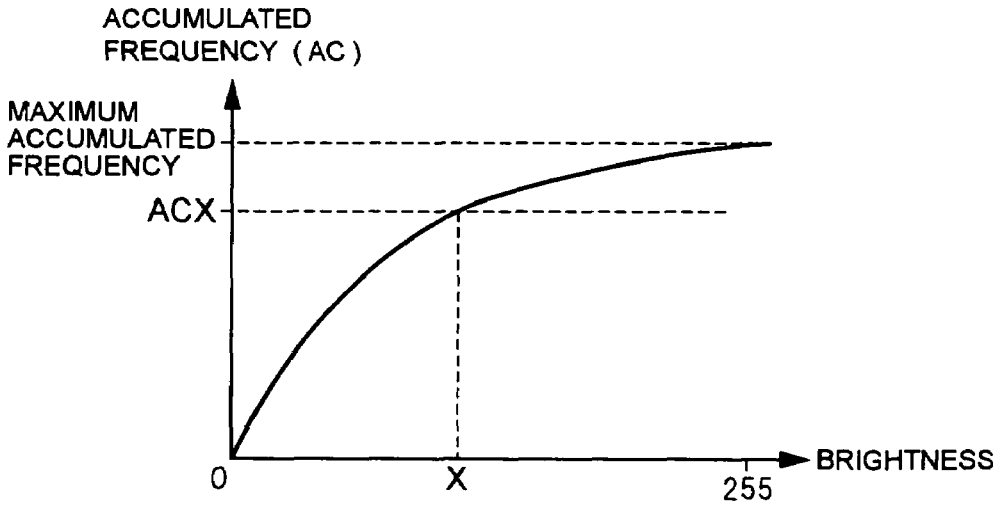

FIG. 9A is a diagram showing the brightness level frequency DF for every brightness level generated by the brightness level frequency data generation circuit 31 based on an input video signal that does not include such text information. FIG. 9B is a diagram showing a sequence of accumulated brightness level frequencies generated by the accumulation arithmetic circuit 32 based on such a brightness level frequency DF.

Figure 10A:
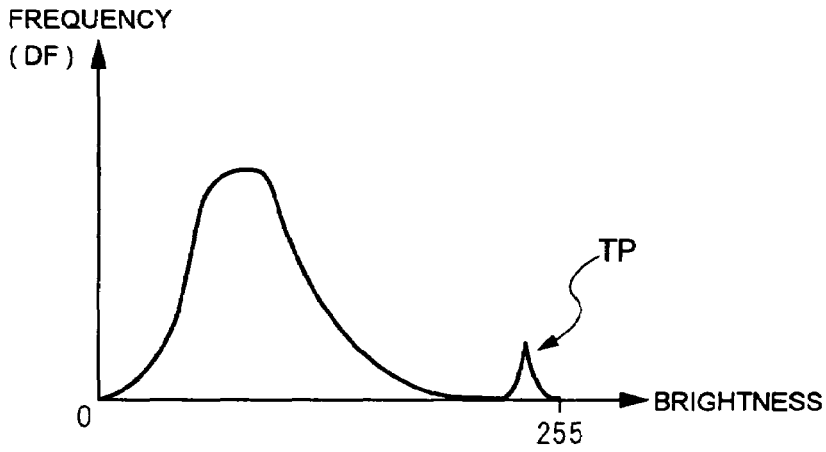
FIGS. 10A and 10B are diagrams showing, respectively, an exemplary brightness level frequency DF and an exemplary accumulated brightness level frequency AC to be generated based on a video signal of a video including text information, e.g., subtitles or newsbar.
Figure 10B:
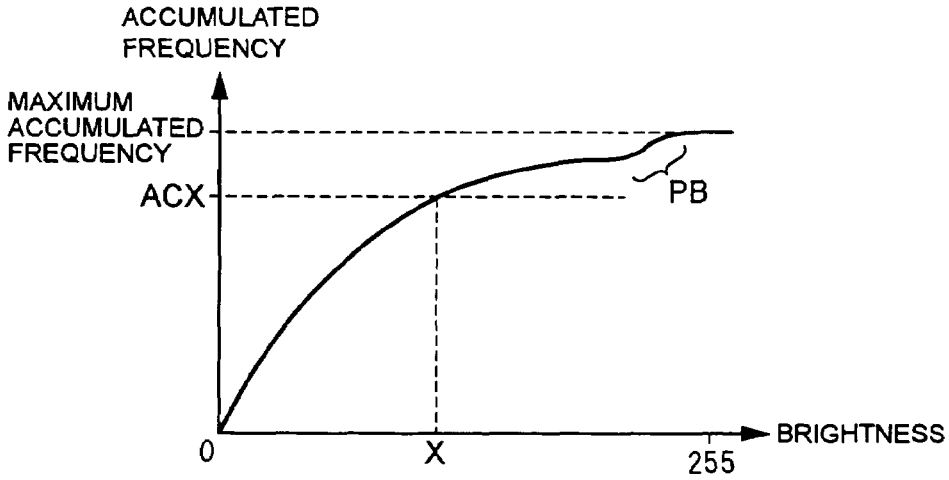

FIG. 10A is a diagram showing the brightness level frequency DF for every brightness level generated by the brightness level frequency data generation circuit 31 based on an input video signal including such text information, e.g., subtitles or a newsbar. FIG. 10B is a diagram showing a sequence of the accumulated brightness level frequencies generated by the accumulation arithmetic circuit 32.

As shown in FIG. 10A, when an input video signal includes text information such as subtitles or newsbar, a frequency TP corresponding to the subtitles or a newsbar exits in a high-brightness portion, i.e., in the vicinity of the brightness level "255". Therefore, the accumulated brightness level frequency sequence in which such brightness frequencies are accumulated includes, as shown in FIG. 10B, an accumulated frequency increase period PB in relation to the frequency TP.

Here, the SF boundary value generation circuit 8 regards Q %, e.g., 90%, of the maximum accumulated frequency in the accumulated brightness level frequency sequence of FIG. 9A or 9B as the effective maximum accumulated brightness level frequency ACX. Next, the SF boundary value generation circuit 8 regards the brightness level corresponding to the effective maximum accumulated brightness level frequency ACX in the accumulated brightness level frequency sequence as the effective maximum brightness level X. As shown in FIG. 7, based on this effective maximum brightness level X, the SF boundary value generation circuit 8 generates the SF boundary values S1 to S11 indicating the boundary values of a brightness range for the sub-fields S1 to SF12. At this time, the effective maximum brightness level X is the brightness level corresponding to the effective maximum accumulated brightness level frequency ACX including the value of Q % (90%) of the maximum accumulated frequency. As shown in FIG. 10B, the effective maximum accumulated brightness level frequency ACX is not reflecting the frequency TP corresponding to the maximum brightness components such as subtitles or newsbar. Therefore, the effective maximum brightness level X corresponding to the effective maximum accumulated brightness level frequency ACX may be substantially the same between two cases, i.e., a case where the frequency TP corresponding to the subtitles, or a newsbar exists, or others as shown in FIG. 10A, and a case where no such frequency TP exists as shown in FIG. 9A. Therefore, no change is observed to the SF boundary values S1 to S11 that are set based on the effective maximum brightness level X.

Accordingly, even if a television video signal is suddenly superimposed with a high-bright text image signal corresponding to a news flash, e.g., about an earthquake, the setting state of the sub-fields shows no transition so that the resulting display image does not cause viewers to feel something is wrong.

SECOND EMBODIMENT

Figure 11:
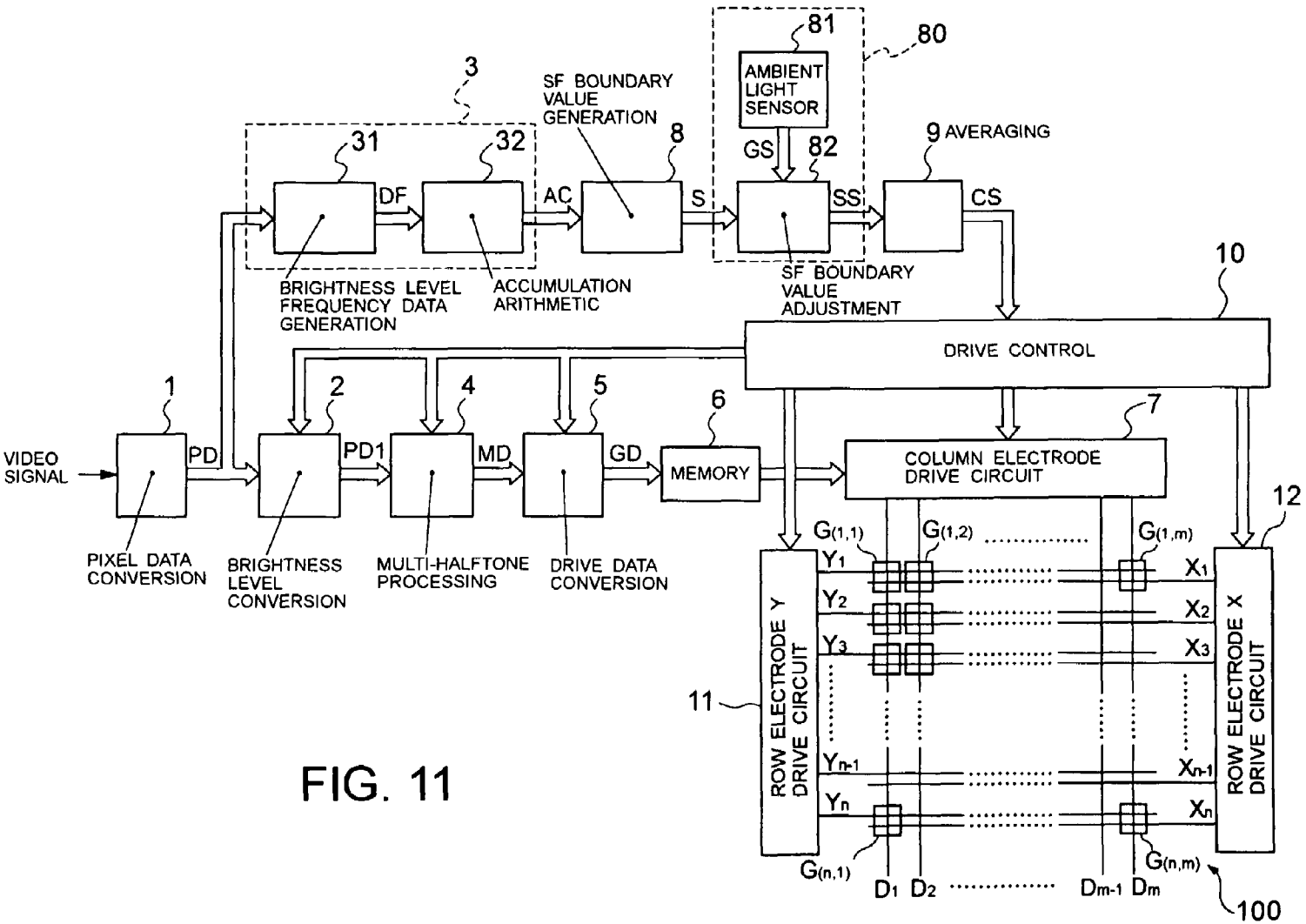
FIG. 11 is a diagram showing another configuration of the plasma display device as the display device of the invention.

FIG. 11 is a diagram showing another configuration of the plasma display device as the display device of the present invention.

In the plasma display device of FIG. 11, an SF number assignment change circuit 80 is provided between the SF boundary value generation circuit 8 and the averaging circuit 9 of FIG. 1. The remaining configuration and the operation, except for the SF number assignment change circuit 80 is the same as that of FIG. 1. Thus, the described below is the operation of the plasma display device of FIG. 8, and mainly relates to the operation of the SF number assignment change circuit 80.

The SF number assignment change circuit 80 is configured by an ambient light sensor 81 and an SF boundary value adjustment circuit 82. The ambient light sensor 81 detects the light intensity of the position at which the plasma display is disposed, and an ambient light intensity signal GS indicating the light intensity is provided to the SF boundary value adjustment circuit 82. The SF boundary value adjustment circuit 82 adjusts the SF boundary values S1 to S11 provided by the SF boundary value generation circuit 8 based on the light intensity indicated by the ambient light intensity signal GS. The adjustment results are forwarded to the averaging circuit 9 as SF boundary values SS1 to SS11. That is, when the light intensity indicated by the ambient light intensity signal GS is smaller than a predetermined value, the SF boundary value adjustment circuit 82 increases the number of sub-fields by a predetermined number for assignment to a low-brightness segment region. The SF boundary value adjustment circuit 82 then adjusts the SF boundary values S1 to S11 so as to decrease the number of sub-fields for assignment to a high-brightness segment region by the increased number. On the other hand, when the light intensity indicated by the ambient light intensity signal GS is equal to or larger than the predetermined value, the SF boundary value adjustment circuit 82 increases the number of sub-fields by a predetermined number for assignment to the high-brightness segment region. The SF boundary value adjustment circuit 82 then adjusts the SF boundary values S1 to S11 so as to decrease the number of sub-fields for assignment to the low-brightness segment region by the increased number.

As such, according to the SF number assignment change circuit 80, the number of sub-fields is increased for assignment to the low-brightness segment region based on human sight that becomes sensitive to low-brightness images in any dark place so that the halftone representation can be improved for any low-brightness images.

Note that, in the embodiment, the SF boundary value generation circuit 8 generates the SF boundary values S1 to S11 based on the effective maximum brightness level X. Alternatively, this SF boundary value generation circuit 8 may be equipped with a memory that stores the SF boundary values S1 to S11 corresponding to various effective maximum brightness levels X. That is, as described in the foregoing, the SF boundary value generation circuit 8 derives the effective maximum brightness level X corresponding to the effective maximum accumulated brightness level frequency ACX from the accumulated brightness level frequencies $AC_0$ to $AC_{255}$, and from the memory, reads the SF boundary values S1 to S11 corresponding to the effective maximum accumulated brightness level frequency ACX.

As such, in the display device described above, a brightness level frequency indicated by an input video signal is accumulated in decreasing order or increasing order of the brightness level so that the accumulated brightness level frequency (AC) is calculated for every brightness level. The brightness level (X) corresponding to the effective accumulated brightness level frequency (ACX), smaller by a predetermined value than any one of the accumulated brightness level frequencies indicated as maximum, is used as a basis to set the number of sub-fields for assignment to each different brightness segment region. With such a configuration, the resulting display device can provide favorable halftone representation without causing viewers to feel something is wrong, no matter what type of display images. This application is based on a Japanese patent application No. 2005-166511 which is hereby incorporated by reference.

What is claimed is:

1. A display device comprising a display panel including pixel cells, each pixel cell emitting light in each of a plurality of sub-fields for gray-scale display, each of the plurality of sub-fields assigned to a light-emitting period, the plurality of sub-fields constituting a field of a display period for an input video signal, said display device comprising:

a brightness level frequency generation portion for deriving, as a brightness level frequency, a frequency for every brightness level of said input video signal on a frame basis;

an accumulated brightness level frequency generation portion for deriving an accumulated brightness level frequency corresponding to each of the brightness levels by adding said brightness level frequency; and a control portion for setting the number of sub-fields for assignment to each different brightness segment region based on an effective maximum brightness level, which is a brightness level corresponding to said accumulated brightness level frequency that is smaller by a predetermined value than any one of said accumulated brightness level frequencies indicated as maximum, wherein said control portion includes a boundary value generation portion for generating a boundary value of a brightness level for each of said sub-fields based on said effective maximum brightness level, and a drive control portion for halftone-driving said pixel cells by said sub-fields, each set with the boundary value.

2. The display device according to claim 1, wherein said input video signal is derived by applying a gamma correction process to a source video signal representing an image for display.

3. The display device according to claim 1, wherein said control portion includes a memory storing information of the boundary values with a correlation to said effective maximum brightness level, and the boundary value of the brightness level is acquired for each of said sub-fields by reading from the memory the boundary values correlated to the effective maximum brightness level.

4. A display device comprising a display panel including pixel cells, each pixel cell emitting light in each of a plurality of sub-fields for gray-scale display, each of the plurality of sub-fields assigned to a light-emitting period, the plurality of sub-fields constituting a field of a display period for an input video signal, said display device comprising:

a brightness level frequency generation portion for deriving, as a brightness level frequency, a frequency for every brightness level of said input video signal on a frame basis;

an accumulated brightness level frequency generation portion for deriving an accumulated brightness level frequency corresponding to each of the brightness levels by adding said brightness level frequency;

an ambient light sensor that detects light intensity around the display panel as an ambient light intensity; and a control portion for setting the number of sub-fields for assignment to each different brightness segment region based on said ambient light intensity and an effective maximum brightness level, which is a brightness level corresponding to said accumulated brightness level frequency that is smaller by a predetermined value than any one of the accumulated brightness level frequencies indicated as maximum, wherein when said ambient light intensity is equal to or higher than said predetermined value, said control portion assigns a larger number of sub-fields to a halftone region compared with a case when said ambient light intensity is lower than said predetermined value.

5. The display device according to claim 4, wherein said input video signal is derived by applying a gamma correction process to a source video signal representing an image for display.

6. The display device according to claim 4, wherein when said ambient light intensity is lower than said predetermined value, said control portion assigns a larger number of sub-fields to a low-brightness region compared with a case when said ambient light intensity is equal to or higher than said predetermined value.

* * * * *